US007032776B2

(12) United States Patent
Hieb

(10) Patent No.: US 7,032,776 B2
(45) Date of Patent: Apr. 25, 2006

(54) VENDING MACHINE BUCKET DRIVE CONTROL

(75) Inventor: Larry Hieb, Fresno, CA (US)

(73) Assignee: The Vendo Company, Fresno, CA (US)

( * ) Notice: Subject to any disclaimer, the term of this patent is extended or adjusted under 35 U.S.C. 154(b) by 132 days.

(21) Appl. No.: 10/214,994

(22) Filed: Aug. 8, 2002

(65) Prior Publication Data

US 2004/0030444 A1 Feb. 12, 2004

(51) Int. Cl.

| | |
|---|---|
| ***B65H 59/00*** | (2006.01) |
| ***B65H 3/00*** | (2006.01) |
| ***B65H 1/08*** | (2006.01) |
| ***B65H 3/44*** | (2006.01) |
| ***G07F 11/16*** | (2006.01) |

(52) U.S. Cl. ..... 221/231; 221/230; 221/129; 221/130; 221/266; 221/265

(58) Field of Classification Search ..... 221/230, 221/231, 129, 130, 266, 265; 318/430; 700/239

See application file for complete search history.

(56) References Cited

U.S. PATENT DOCUMENTS

| | | | | |
|---|---|---|---|---|
| 2,004,418 | A * | 6/1935 | Radtke | 221/116 |
| 3,164,294 | A * | 1/1965 | Phillips et al. | 221/84 |
| 3,556,345 | A | 1/1971 | Rowekamp | 221/242 |
| 3,674,175 | A | 7/1972 | Jaquish | 221/92 |
| 3,675,816 | A * | 7/1972 | Bourke et al. | 194/206 |
| 3,684,131 | A | 8/1972 | Kurimsky | 221/242 |
| 3,753,514 | A * | 8/1973 | Naguet | 221/129 |
| 3,757,998 | A | 9/1973 | Millies et al. | 221/242 |
| 3,883,038 | A | 5/1975 | Bookout | 221/67 |
| 3,967,175 | A * | 6/1976 | Turley | 318/258 |
| 4,087,020 | A * | 5/1978 | Krakauer | 221/84 |
| 4,096,969 | A | 6/1978 | Ragusa | 221/199 |
| 4,126,217 | A * | 11/1978 | Bock | 194/291 |
| 4,168,784 | A | 9/1979 | Heier | 221/125 |
| 4,254,892 | A | 3/1981 | Lee | 221/90 |
| 4,278,182 | A * | 7/1981 | Ahlstrom | 221/5 |
| 4,331,259 | A * | 5/1982 | Imamura | 221/11 |
| 4,429,806 | A * | 2/1984 | Schwarzli | 221/20 |
| 4,727,798 | A * | 3/1988 | Nakamura | 99/323.9 |
| 4,757,915 | A | 7/1988 | Albright et al. | 221/75 |
| 4,846,367 | A | 7/1989 | Guigan et al. | 221/81 |

(Continued)

FOREIGN PATENT DOCUMENTS

JP 04077894 A * 3/1992

(Continued)

OTHER PUBLICATIONS

International Search Report for PCT/US03/24773 filed Aug. 7, 2003, Feb. 6, 2004.

*Primary Examiner*—Gene O. Crawford
*Assistant Examiner*—Michael E Butler
(74) *Attorney, Agent, or Firm*—Baker Botts L.L.P.

(57) ABSTRACT

The disclosed invention is a dispensing apparatus and method for dispensing product from a vending machine. The invention employs a motor for bi-directionally rotating a dispenser bucket between two bumpers which physically obstruct and limit the rotational travel, a motor controller for monitoring the current drawn by the motor and signals received from a product vend detection sensor. The motor controller uses monitored information to control the rotational direction and stopping positions of the dispenser bucket. The invention eliminates the need for timing cams and switches and eliminates the need for anti-theft device to prevent product theft from the dispenser bucket.

25 Claims, 6 Drawing Sheets

Gate Rotated CW to Holding Position

U.S. PATENT DOCUMENTS 4,854,477 A * 8/1989 Kurosawa et al. ..... 221/1
4,854,743 A * 8/1989 Sexton et al. ..... 384/130
4,940,161 A 7/1990 Hieb ..... 221/67
4,986,615 A 1/1991 Hieb et al. ..... 312/45
5,029,520 A * 7/1991 Okada ..... 99/357
5,127,546 A 7/1992 Chen ..... 221/242
5,186,795 A * 2/1993 Hall ..... 205/659
5,320,025 A * 6/1994 Ikari ..... 91/459
5,385,265 A * 1/1995 Schlamp ..... 221/7
5,404,797 A * 4/1995 Millar ..... 99/357
5,511,646 A 4/1996 Maldanis et al. ..... 194/217
5,516,003 A 5/1996 Hebert ..... 221/130
5,529,207 A 6/1996 Oden et al. ..... 221/67
5,605,249 A * 2/1997 Gonyea ..... 221/6
5,791,516 A 8/1998 Wittern, Jr. et al. ..... 221/301
5,799,823 A * 9/1998 Feltrin ..... 221/298
5,876,285 A * 3/1999 Salour et al. ..... 463/29
5,941,921 A * 8/1999 Dasys et al. ..... 701/50
5,993,117 A * 11/1999 Lancaster et al. ..... 406/3
5,996,838 A 12/1999 Bayer et al. ..... 221/75
6,000,318 A * 12/1999 Weiss et al. ..... 99/323.7
6,116,462 A 9/2000 Takamura et al. ..... 221/241
6,179,161 B1 1/2001 Kovens et al. ..... 221/131
6,199,720 B1 * 3/2001 Rudick et al. ..... 221/6
6,209,868 B1 * 4/2001 Norton ..... 273/118 R
6,227,407 B1 * 5/2001 Simeri et al. ..... 221/254
6,302,293 B1 10/2001 Wittern, Jr. et al. ..... 221/92
6,390,328 B1 * 5/2002 Obermeier et al. ..... 221/203
6,392,373 B1 * 5/2002 Glasgow et al. ..... 318/430
6,409,045 B1 6/2002 Lauer ..... 221/124
6,513,887 B1 2/2003 Paczkowski et al. ..... 312/45
6,550,638 B1 4/2003 Mochida ..... 221/124
6,561,380 B1 * 5/2003 Suzuki ..... 221/266

FOREIGN PATENT DOCUMENTS

WO WO000116903 A1 * 3/2001
WO PCT/US03/024897 8/2003

* cited by examiner

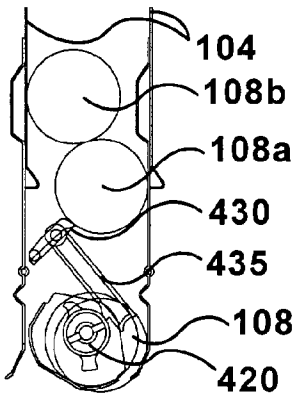
Figure 4a "Home" or Stand-by Position
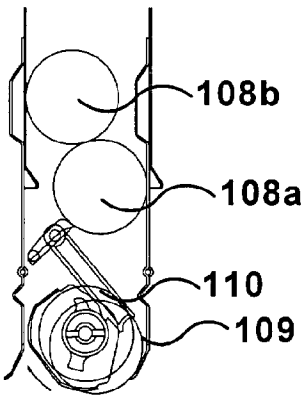
Figure 4b Bucket Rotates Clockwise
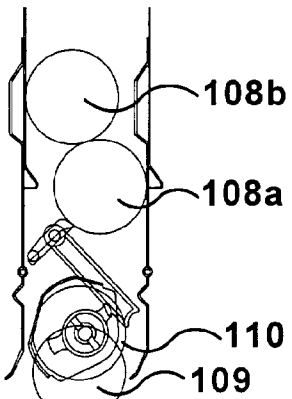
Figure 4c Front Product Vended Rear Product Held
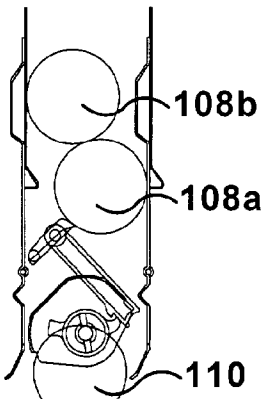
Figure 4d Rear Product Vended
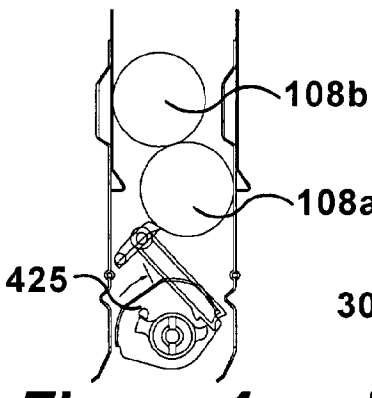
Figure 4e Bumper Stop Reached CW
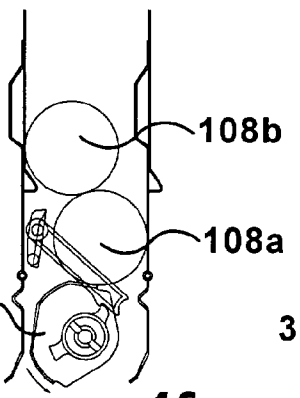
Figure 4f Gate Rotated CCW to Up Position
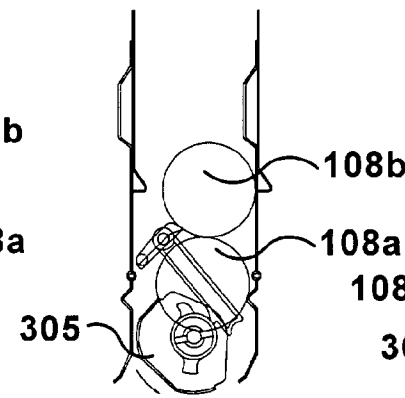
Figure 4g Gate Rotated CW to Holding Position
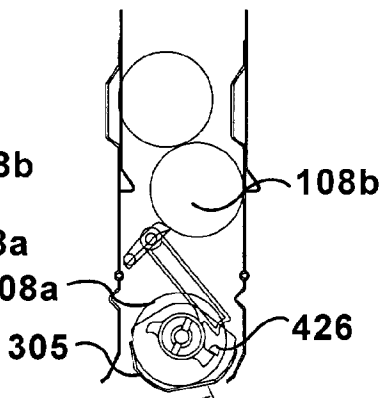
Figure 4h Bumper Stop Reached CCW

VENDING MACHINE BUCKET DRIVE CONTROL

TECHNICAL FIELD OF THE INVENTION

This invention relates in general to the field of vending machines, and more particularly, to a system and method for controlling a product dispensing mechanism in a vending machine.

BACKGROUND OF THE INVENTION

Vending machines are widely used to dispense beverages, food, and other perishable and nonperishable goods. Many vending machines, particularly those that dispense beverages, have column walls or partitions between which the individual bottles or cans and the like are stacked in a vertical column. At the bottom of any given stack is a dispensing mechanism that dispenses a selected bottle or can after receipt of payment by the vending machine. One type of dispensing mechanism is known as a bucket type mechanism. Generally, bucket type dispensing mechanisms have a partial cylindrical shape that accommodates within it a row of bottles or cans that is positioned laterally relative to the length of the cylinder. A portion of the circumference of the cylinder, however, is open, therefore allowing the bottles or cans to enter into, and exit from the bucket at various stages of the vend cycle. A motor or other rotational means rotates the bucket about its axis. A gauging means, appropriately located below the bucket, is used to create steps of various sizes, which generally correspond to the length of the individual cans or bottles being dispensed. The opening in the bucket is of a sufficient size so that when rotated to a certain point, the first bottle or can is free to fall out of the bucket dispenser and into the product chute through which it is dispensed to the customer, while the next to vend bottle or can remains in the bucket, held by the next gauging step. During subsequent vends, the bucket rotates to expose the next bottle or can, allowing it to fall. After all products have been dispensed from the bucket, the dispensing mechanism continues through the reload phase of the vend cycle whereby the next row of products enter the bucket in preparation for the subsequent vending cycles. The positions at which the rotation of the bucket stops during the vending cycles are generally controlled by a switch that engages a timing cam mounted on the motor shaft. The switch signals a motor controller to stop the motor at predetermined positions. The timing cam is adjustable to vary the number of stopping positions in order to accommodate the variable number of products in a row. Thus, products are initially seated within the bucket, but are unseated and dispensed as the bucket rotates.

Typically, the gauging means must be reconfigured to accommodate the variability of the diameter of the product being dispensed. In this case, the gauging means is created by a series of steps on the lower edge of the partition, and a series of steps on the vending edge of the bucket. The opposite edge of the bucket is straight. In this case, this edge is used to lower a row of products into the bucket during the reload phase of the vend cycle. This is significant in that in most conventional bucket type dispensing mechanisms, the motor rotates the bucket in a constant direction 360° about its axis, therefore the edge of the bucket that is used to lower the product into the bucket during the reload phase of the vend cycle is also used to gauge product out of the bucket during the dispensing phase of the vend cycle. Therefore, if the gauging edge of the bucket is stepped to help control the dispensing of product, it can cause undesirable conditions during the reload phase. Namely, when a row of products is being lowered into the bucket, and if the bucket edge being used to lower these products is stepped, the tendency is that the individual products within a product row enter the bucket at different times. This causes the uniformity of the entire column of product to shift relative to itself front to back. This shifting can result in a number of problems that ultimately can lead to undesirable operation of the vending mechanism. To avoid this undesirable condition, the movement of the bucket can be controlled in a way that results in an oscillating movement, thereby allowing one "straight" edge of the bucket to control the lowering of product into the bucket during the reload phase of the vend cycle, and the other "stepped" edge of the bucket to function as a gauging mean in the dispensing phase of the vend cycle. In the past, this type of oscillating motion has been achieved by use of complex "crank and link" mechanisms that couple the motor to the bucket.

Vending machines of this type are vulnerable to various methods to attempt to obtain product without paying. After a product has been dispensed, and additional products remain in the bucket, the opening that was created to free the first product dispensed remains. If the next product in the bucket is caused to move forward into the space previously occupied by the first product, it will be unseated and drop through the opening onto the product chute through which it is dispensed to, in this case, a thief. This forward movement of product can be achieved by rocking or tipping the vending machine, or by some individual reaching their arm, or some device such as a wire, through the product chute. To combat this type of theft, existing vending machines having bucket type dispensing mechanisms have incorporated additional "anti-theft" clips or devices. These devices generally hang down, or spring up in the bucket to create a barrier or obstacle that prevents or discourages product from moving forward in the bucket and thus not allowing the product to drop through the opening through which the first, or previously vended, product passed. Although these clips have added additional cost and complexity to each vending machine, they have not succeeded in eliminating this type of theft.

SUMMARY OF THE INVENTION

It is an object of the present invention to provide an improved method and apparatus for product dispensing in a vending machine.

Another object of the present invention is to provide such a method and apparatus that does not require adjustment in order to accommodate and dispense products of various diameters.

Another object of the present invention is to provide such a method and apparatus that does not require timing cams and switches to control the stopping positions of the product dispensing mechanism.

Another object of the present invention is to provide such a method and apparatus that utilizes a "bucket" type dispensing element that is oscillated without the need of a crank and link mechanism.

A further object of the present invention is to provide such a method and apparatus that prevents products from being inappropriately dislodged when the vending machine is rocked or tipped, or pulled forward by other means, without the employment of additional "anti-theft" devices.

Thus, the present invention achieves these objects in a method and apparatus for product dispensing. The apparatus includes a motor driven product dispenser having a gauging means that allows multiple products to sequentially be freed one at a time in accordance with the amount of rotation that the product dispenser travels, a motor controller used to control the product dispenser drive motor, a product delivery chute located below the product dispenser for receiving product as they are freed from the product dispenser and transporting them to a product delivery hopper where they are presented to the consumer, a product vend sensor mounted to the delivery chute to detect when a product has been freed from the product dispenser and thereby signal the motor controller to stop rotation of the motor before additional products are freed. Thus, the present invention eliminates the need to adjust the gauging elements of the product dispensing mechanism to accommodate products of various diameters.

The invention also includes a set of bumper stops that physically limit the rotation of the product dispenser motor, the motor being bi-directionally operated by the motor controller, and the motor controller having the capability to monitor the current drawn by the motor thereby permitting the controller to recognize when the dispenser has reached predetermined maximum clockwise and counterclockwise rotation stop positions of the motor in accordance with predetermined programmed functions contained therein. The control functions, in conjunction with the ability to detect when a product has been freed from the product dispensing mechanism via input signals from the product vend sensor, eliminate the need for the timing cams and switches that are normally used by prior product dispensing systems. Also, the resulting oscillating movement of the product dispenser is achieved without the use of a traditional crank and link mechanism.

The motor controller of the present invention also includes programmed functions that cause the motor to run in a reverse direction after stopping momentarily upon receiving a signal from the product vend sensor that a product has been freed, thereby closing off the opening in the product dispenser through which the recently vended product passed. The duration of this reverse directional rotation may be determined by the motor controller logic such that it is substantially equal to the time that the motor rotated in the original direction in order to move from a "standby" position to the position that allowed the product to pass through. The possibility of products being inappropriately dislodged from the product dispenser in the event that the vending machine is rocked or tipped or pulled forward by other means is eliminated. Thus, there is no need or desire to install additional anti-theft devices.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIGS. 4*a*–4*h* are front views of a dispensing assembly according to the present disclosure at different rotational orientations;

DETAILED DESCRIPTION OF THE INVENTION

Figure 1:
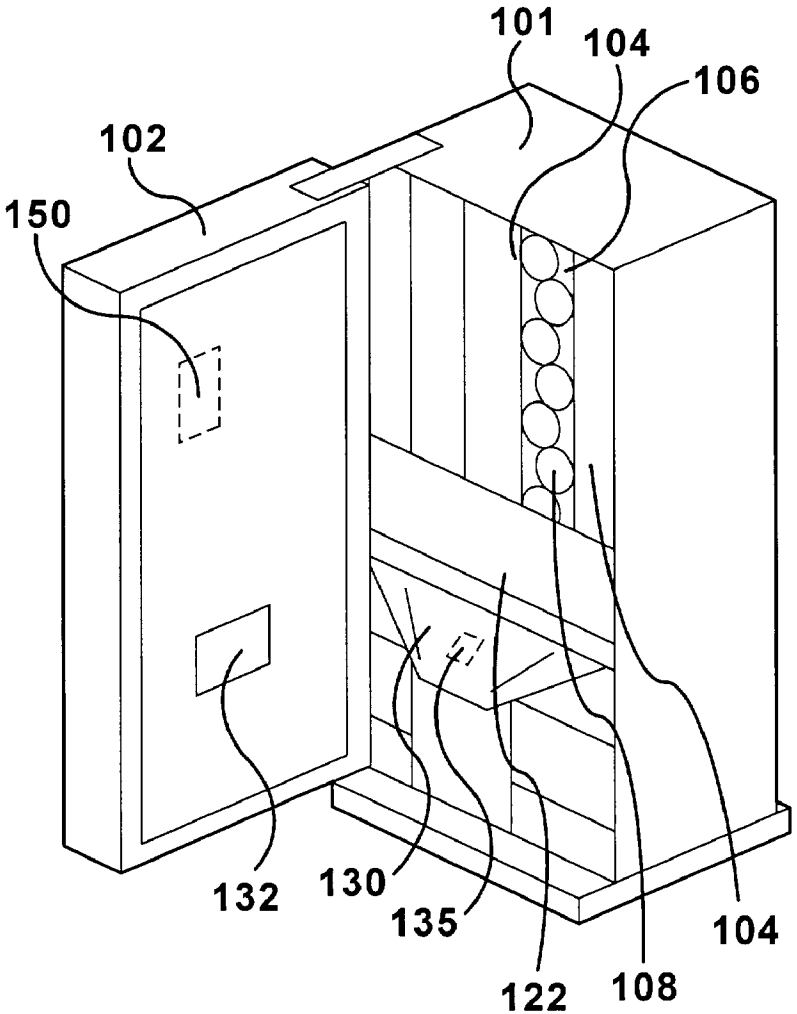
FIG. 1 is an interior view illustrating a vending machine incorporating the disclosed dispensing assembly.

Shown in FIG. 1 is the interior of a vending machine having a housing 101 and a door 102 pivotally coupled to the housing. Within the housing, products 108, such as beverages, are stored vertically in channels 106 formed between successive partitions 104. Beverages are typically positioned laterally within the channel and stacked on top of one another to form one or more vertical columns as shown in FIG. 1. A rear plate 322 (FIG. 3) extends across behind the rear side of the partitions 104 (FIG. 1), and a front plate 122 (FIGS. 1 and 5) extends across the front side of at least a lower portion of the partitions. A product dispensing chute 130 is positioned below the channel 106 to receive products 108 that are dispensed by the dispensing assembly and to deliver them to a location at which they can be retrieved by a customer through an aperture 132 in the vending machine door.

Figure 2:
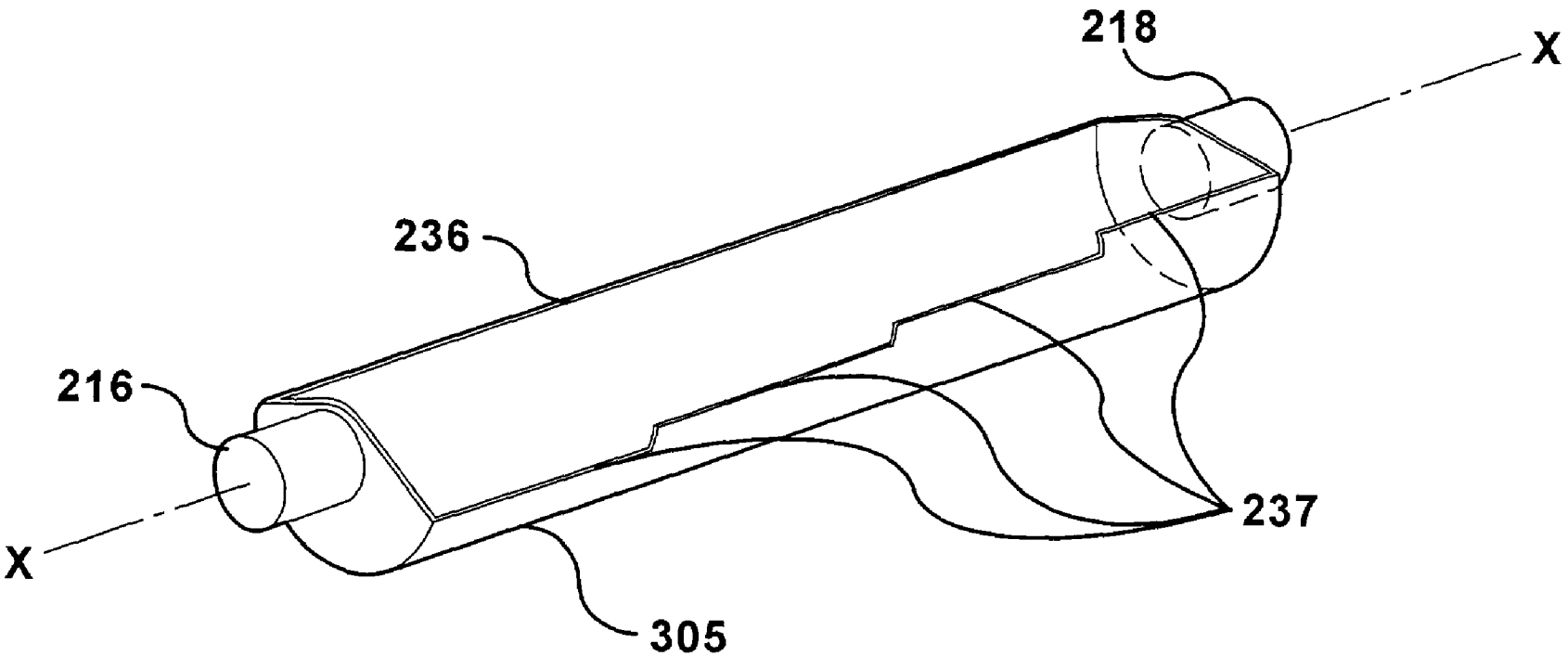
FIG. 2 illustrates the bucket type dispenser removed from the vending machine.
Figure 3:
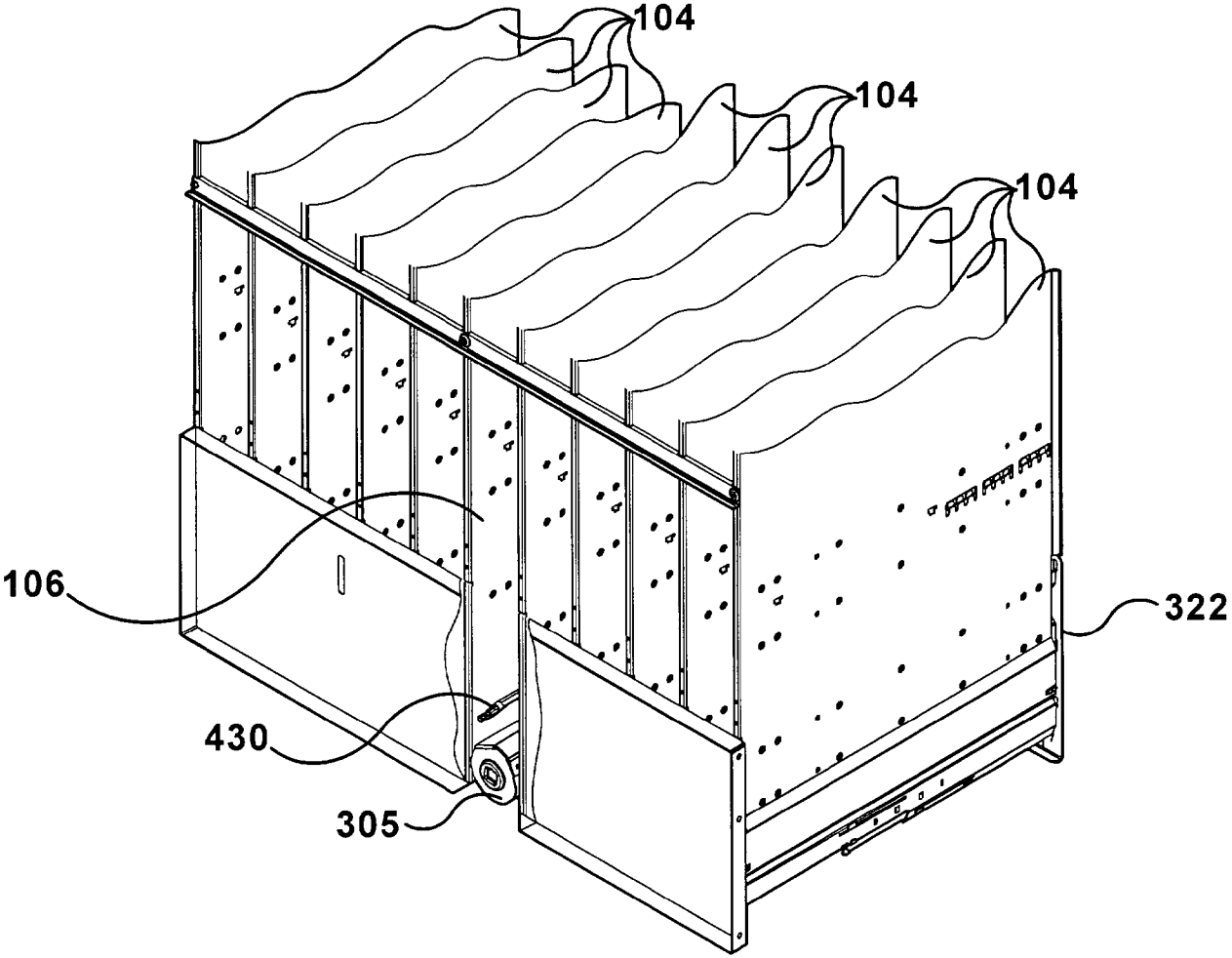
FIG. 3 is a perspective front view of a dispensing assembly according to the present disclosure removed from a vending machine.

As shown in FIGS. 2–6, a dispensing assembly 600 (FIG. 6) is also included for dispensing the products 108 after receipt of payment by the vending machine. As shown in FIG. 3, the dispensing assembly includes a dispenser 305 that is positioned substantially horizontally at the bottom of the channel 106 and between partitions 104, and extends laterally along the channel. The dispenser may extend substantially along the length of the channel, or along the portion of the channel in which products are stacked. The dispenser 305 is mounted to front and rear plates so that it is rotatable about a central axis x—x (FIG. 2). This may be accomplished by any suitable means, such as by shafts 218 and 216 or the like extending through apertures in each of the front and rear panels respectively.

The dispenser has a "bucket" type configuration in that, when rotationally oriented as shown in FIG. 4*a*, it is capable of receiving and holding within it one or more products. This bucket type dispenser has an open portion through which it can receive one or more products, and through which it can dispense or deliver the product when the open portion is facing substantially downward, as shown in FIGS. 4*c* and 4*d* and as described more fully below. The dispenser has a first edge 236 that is substantially straight. This straight edge is used to control product as they are received into the dispenser from the channels 106 by maintaining the alignment of those product in a single uniform row. The dispenser also has a second edge 237 that has a series of steps that are used to create a gauging means whereby products received into the dispenser can be individually dispensed depending on the amount of rotation induced upon the dispenser by the motor assembly 500 as described below. According to one embodiment, the dispenser is substantially cylindrical in overall shape, but other configurations are also possible.

Figure 5:
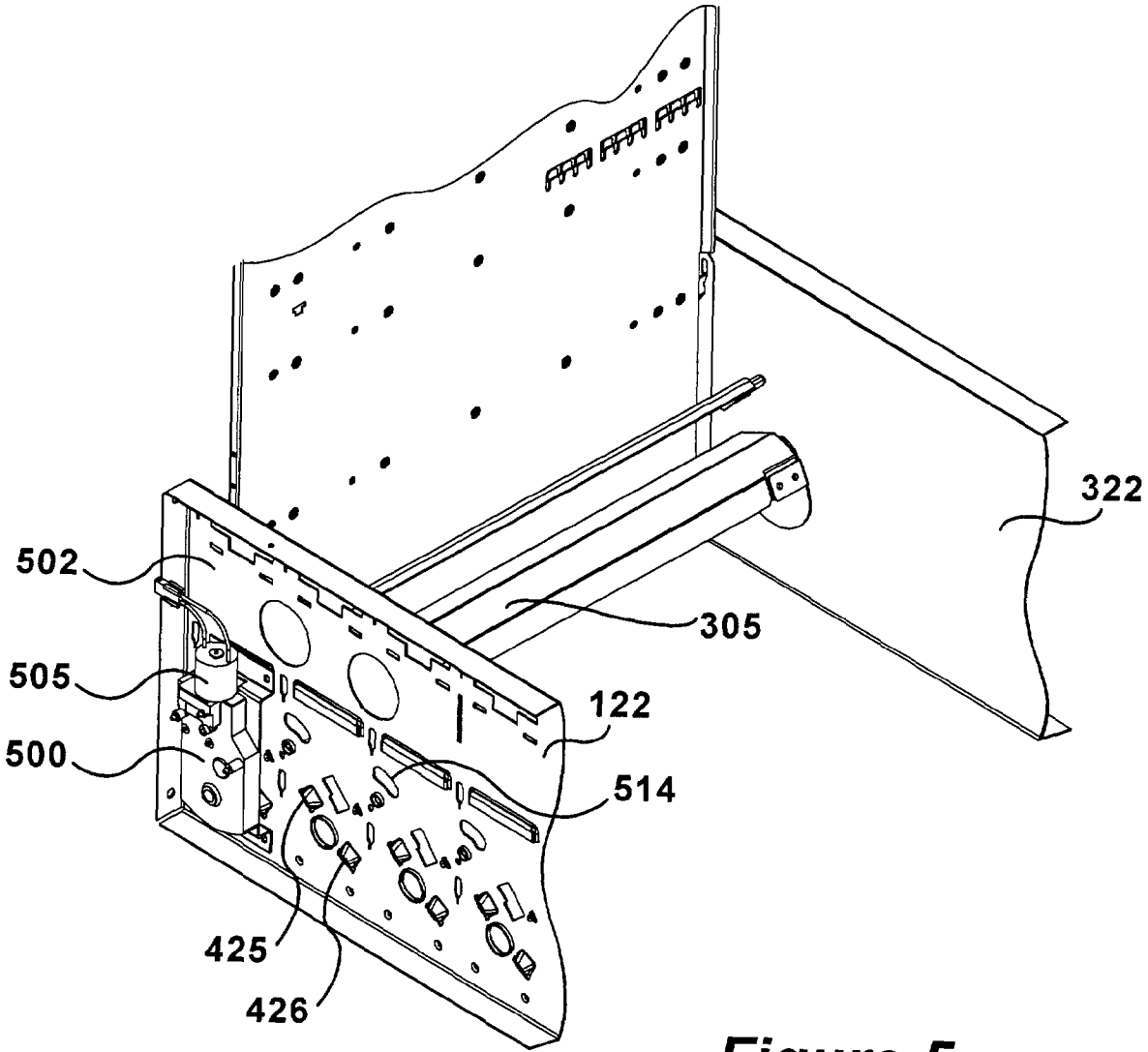
FIG. 5 is a perspective view of a motor assembly mounted on a front panel of a vending machine.
Figure 6:
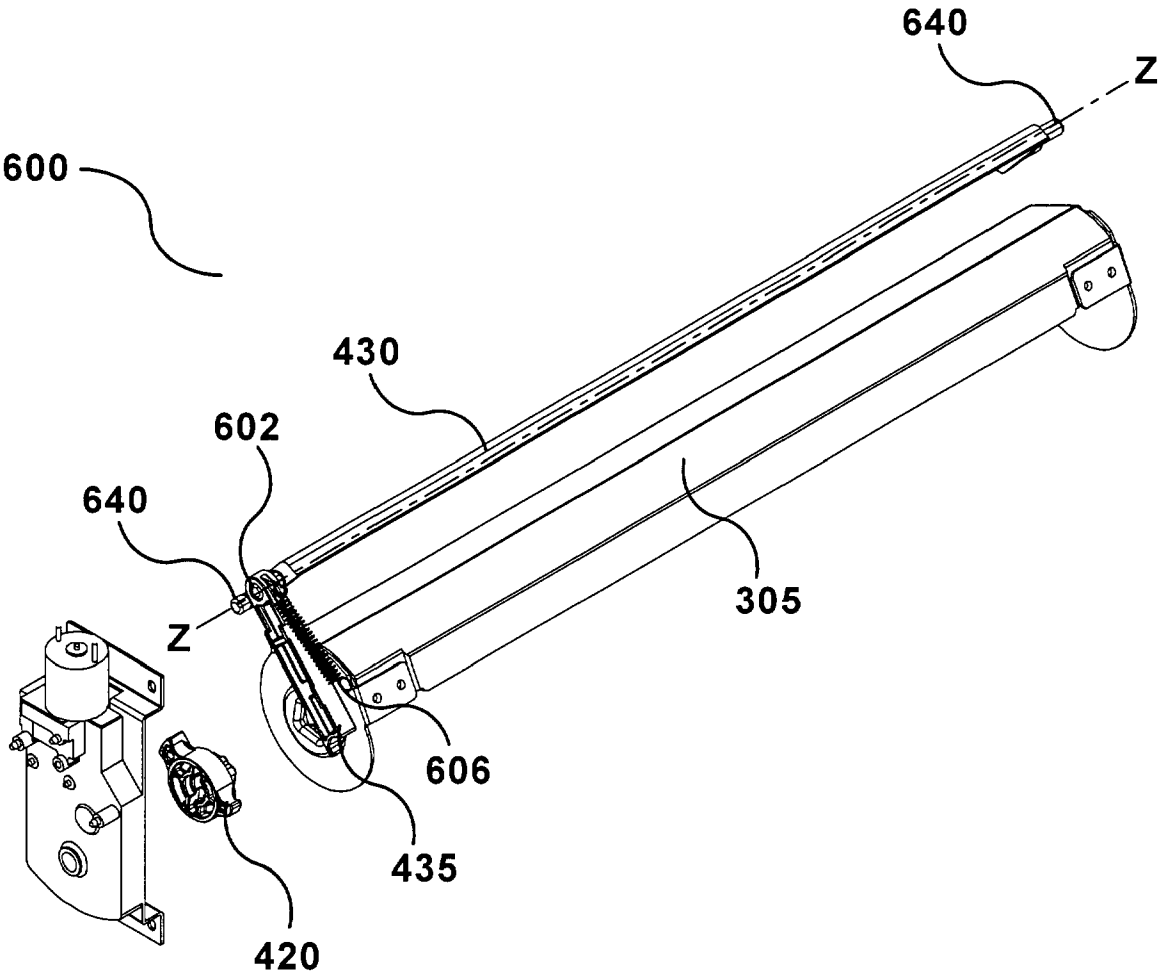
FIG. 6 is a view of components of a dispensing assembly according to the present disclosure.

The dispensing assembly 600 (FIG. 6) also includes a motor assembly 500 (FIG. 5) including a motor 505 and a motor controller 150 (FIG. 1) for rotating and controlling the rotational position of the dispenser as will be described further below. The motor assembly is fixedly secured to the vending machine, and in one embodiment is mounted on a front side 502 of the front panel 122, and rigidly coupled to the dispenser 305 by a coupler cam 420 (FIGS. 5 and 6). A set of bumpers 425 and 426 is formed into the front panel, and is positioned so that it will prevent rotation of the coupling cam past predetermined positions as will be described further below.

The motor controller may be programmed to a value that corresponds to the number of products received by the dispenser as previously described. For example, if each row of products 108 stored in channel 106 consists of two beverage containers, then the programmable value of the controller must be set at "2." In the case that each row of products consists of four beverage containers, the programmable value of the controller must be set to "4." The controller also has the ability to keep track of the number of products that have been dispensed during a given vend cycle, and thus knows when the dispenser is empty, thereby allowing the dispenser to continue through a reload cycle in order to prepare the next row of products for subsequent dispensing.

The dispensing assembly further includes a gate 430 (FIGS. 4 and 6) that extends substantially along the length of the dispenser and prevents products 108*a* from dropping into the dispenser before reloading of the dispenser is desired, as shown in FIGS. 4*a–e*. The gate is mounted to the front and rear plates by a pair of pivot shafts 640 (FIG. 6) incorporated into the gate, so that it is pivotable about an axis z—z. Attached to the gate is a gate link 435 (FIGS. 4 and 6) that is preferably positioned on the front side of the front panel and pivotably coupled to the gate by a pivot pin 602 or the like so that it is movable between a first position illustrated in FIG. 4*a* wherein the gate prevents reloading of the dispenser, and a second position illustrated in FIG. 4*f* wherein the gate does not obstruct products from moving downward within the channel, and thereby allows loading of the dispenser. The pivot pin 602 extends through an aperture 514 (FIG. 5) in the front panel 122 (FIG. 5). Preferably, the aperture 514 is configured so as to guide movement of the gate between the first and second positions in response to movement of the gate link between first and second positions that are described below.

In one embodiment, a spring 606 (FIG. 6) or other resistive force is exerted on the gate link to bias the gate link to return to the gate to the first position.

The operation of the dispensing assembly are described below in greater detail with reference to FIGS. 4*a*–4*h*. FIGS. 4*a*–4*h* illustrate the position of several components of the dispensing assembly at different points during the process of dispensing a row of products. Although the front panel is not shown, it is to be understood that the components of the dispensing assembly are positioned relative to the front panel as described above. FIG. 4*a* illustrates the "home" position of the dispenser, which is where the dispenser remains when the system is idle, or in the stand-by state. As shown, the dispenser is positioned so that its open is facing sufficiently upward so that in this case it will securely hold the row of two products 109 and 110 and so that it is substantially unexposed to the product chute below. The gate and gate link are in their first position in which the gate 430 prevents products from moving downwardly to reload the dispenser.

When the vending machine determines that sufficient payment has been received, and a selection has been made, the process of dispensing a product begins. Controller 150 activates the motor 505 to begin rotating clockwise to thereby also rotate the dispenser and coupling cam 420 clockwise as shown in FIG. 4*b*. As the motor continues to rotate clockwise, the open side of the dispenser becomes oriented such that it is facing significantly downward, allowing the front product 109 to drop out of the dispenser and into the delivery chute 130 (FIG. 1), while allowing the rear product 110 to remain in the dispenser, as shown in FIG. 4*c*. At this point, the motor controller 150 receives a vend-completed signal from a product vend detector 135 (FIG. 1). Upon receiving this signal, the motor controller will stop the rotation of the motor, and reverse its direction. The motor then rotates counterclockwise until the dispenser returns to the home position as identified by 4*a* earlier. At the next vend cycle, the motor again rotates the dispenser, in the clockwise direction as shown in FIG. 4*b*, as controlled by the motor controller. As the motor continues to rotate clockwise, the open side of the dispenser becomes orientated such that it is facing significantly downward, allowing the rear product 110 to drop out of the dispenser and into the delivery chute, as shown in FIG. 4*d*. At this time, the motor continues to rotate in the clockwise direction until the coupling cam 420 contacts the bumper 425 as shown in FIG. 4*e*. At this point the motor stops and reverses direction. The motor, now rotating in the counterclockwise direction, continues to rotate until the coupling cam engages the gate link, and causes it to pivot the gate 430 counterclockwise about its pivot pin 602, thereby causing the gate link 435 to move between the first position in which it prevents reloading of the dispenser and the second position shown in FIG. 4*f* in which it does not rest against a product, allowing products to drop downwardly, until reaching the outer circumference of the dispenser. As the motor continues to rotate counterclockwise, the next row of products 108*a* is gradually lowered into the dispenser bucket. As the row of products lowers into the dispenser, the gate, now under spring tension, follows until it reaches the first position in which it prevents the next row of products 108*b* from lowering beyond a predetermined holding level at which it will not come into contact with the dispenser and therefore will not reload the dispenser when the open side returns to a position facing upwards (FIG. 4*g*).

The motor, dispenser, and coupling cam continue to rotate counterclockwise until the coupling cam contacts the bumper 426 (FIG. 4*h*), and at this point the motor stops and reverses direction, moving clockwise for a predetermined amount of time until the "home" or standby position is reached. At this point, the motor stops and waits for the next signal from the motor controller to begin another vend cycle.

As indicated above, the motor assembly includes a reversible motor 505 and a controller 150 for controlling the rotational direction and position of the dispenser. The controller is electrically coupled to the motor and also monitors the current drawn by the motor. As also indicated above, by interfering with rotational movement of the coupling cam, the bumper physically prevents counterclockwise rotation of the dispenser beyond a predetermined maximum counterclockwise rotation position (FIG. 4*h*), and clockwise rotation of the dispenser beyond the predetermined maximum clockwise dispensing position shown in FIG. 4*e*. As the motor tries to rotate further clockwise beyond the position shown in FIG. 4*e*, it will draw more current, which is sensed by the controller. When the current drawn reaches, or exceeds a predetermined maximum level, for a predetermined amount of time, which in one example may be a maximum of 500 milliamps at 24 volts DC for 500 milliseconds, the controller directs the motor to reverse direction and to rotate counterclockwise.

The motor will continue to drive counterclockwise rotation of the dispenser and coupling cam until it reaches a point at which the coupling cam contacts the other bumper as shown in FIG. 4*h*. As the motor continues to try to drive counterclockwise rotation against the bumper, it again will draw increasingly more current, which will be sensed by the controller. When current draw reaches, or exceeds the predetermined maximum level for the predetermined amount of time, the controller directs the motor to stop rotation. At this point, the motor reverses direction and rotates clockwise for the predetermined time period as previously described. At this point reloading has been completed, and the dispenser has returned to its home position. The dispenser will remain in this home position until further dispensing of products is desired. Thus, the motor assembly is able to easily and efficiently control the rotational direction and position of the dispenser, and ensure that its home position is one in which the open portion of the dispenser is substantially unexposed to the product chute. Further, by using a controller to monitor current and to keep track of the number of vends in a given vend cycle, mechanical switches, timing cams and other mechanical linkages are avoided, reducing the overall complexity of the system.

The procedure described above presumes that reloading of the dispenser is required following dispensing of two products, as is true under circumstances where two products are held by the dispenser at a given time. Many dispensers, however, can accommodate one, two, three or more products within the dispenser at one time. It should therefore be understood that variations to the sequences and description above are easily accomplished to accommodate these variations in product numbers.

The vending machine includes a product vend detector that senses when product vending has occurred and signals the motor controller accordingly. This detector may be a vibration sensor attached to the product chute, an optical sensor mounted below the product dispenser, or another similar device.

Although the present invention has been described in detail, it should be understood that various changes, substitutions and alterations can be made hereto without departing from the spirit and scope of the invention as defined by the appended claims.

What is claimed is:

1. A vending machine, comprising:

a housing;

a dispensing assembly comprising a dispenser for holding and dispensing a product, the dispenser having an open side and being rotatably mounted substantially horizontally within the housing and rotatable about an axis;

a product chute for receiving the product when dispensed by the dispenser;

a reversible motor coupled to the dispenser for rotating the dispenser about the axis; and a controller electrically coupled to the motor for rotating the dispenser from a first position, wherein the open side is substantially unexposed to the product chute and the dispenser holds the product, to a second position, wherein the open side is exposed to the product chute and the dispenser dispenses the product, to a third position that is substantially the same as the first position, wherein the controller monitors the current drawn by the motor and causes the motor to reverse its rotation direction when the detected current exceeds a predetermined amount for a predetermined time.

2. The vending machine according to claim 1, wherein the dispensing assembly further comprising a bumper fixedly positioned so as to interfere with rotation of the dispenser beyond predetermined points in clockwise and counterclockwise directions.

3. The vending machine according to claim 2, wherein after the controller receives a signal from a product vend detector indicating that a product has been dispensed by the dispenser, the controller causes the motor to reverse its rotation direction to rotate the dispenser for a time period until the open side is substantially no longer exposed to the product chute.

4. The vending machine according to claim 3, wherein the time period is substantially equal to the time required for the rotation to dispense the product.

5. The vending machine according to claim 4, wherein the controller receives input signals to determine the number of products being held within the dispenser.

6. The vending machine according to claim 5, wherein the controller is adapted to direct the motor to rotate the dispenser through a reload cycle when the dispenser is empty.

7. The vending machine according to claim 6, wherein the product vend detector comprises an impact sensor attached to the product chute which generates a product dispensed signal when the product impacts the product chute.

8. The vending machine according to claim 7, wherein the dispensing assembly further comprises:

a gate extending along at least a portion of a length of the dispenser, the gate being movable between a first position wherein it prevents reloading of the dispenser, and a second position wherein it does not prevent reloading of the dispenser;

a gate link pivotally coupled to the gate, wherein movement of the gate link causes the gate to pivot between the first and second positions;

a coupling cam coupled to the dispenser for rotation therewith; and the bumper fixedly secured to a panel and positioned relative to the coupling cam so as to prevent rotation of the coupling cam beyond the predetermined points in the clockwise and counterclockwise directions.

9. The vending machine according to claim 8, wherein during rotation, the coupling cam is adapted to move the gate link between the first and second positions.

10. The vending machine according to claim 9, wherein the dispenser is substantially cylindrical in shape.

11. The vending machine according to claim 10, further comprising a first partition and a second partition positioned substantially vertically within the housing and spaced apart so as to form a channel positioned above the dispenser, and the first and second partitions extend along at least a portion of the length of the channel.

12. The vending machine according to claim 6, wherein the product vend detector comprises an optical sensor located beneath the dispenser which generates a product dispensed signal when the product passes from the dispenser to the product chute.

13. The vending machine according to claim 12, wherein the dispensing assembly further comprises:

a gate extending along at least a portion of a length of the dispenser, the gate being movabie between a first position wherein it prevents reloading of the dispenser, and a second position wherein it does not prevent reloading of the dispenser;

a gate link pivotally coupled to the gate, wherein movement of the gate link causes the gate to pivot between the first and second positions;

a coupling cam coupled to the dispenser for rotation therewith; and the bumper fixedly secured to a panel and positioned relative to the coupling cam so as to prevent rotation of the coupling cam bcyond the predetermined points in the clockwise and counterclockwise directions.

14. The vending machine according to claim 13, wherein during rotation, the coupling cam is adapted to move the gate link between the first and second positions.

15. The vending machine according to claim 14, wherein the dispenser is substantially cylindrical in shape.

16. The vending machine according to claim 15, further comprising a first partition and a second partition positioned substantially vertically within the housing and spaced apart so as to form a channel positioned above the dispenser, and the first and second partitions extend along at least a portion of the length of the channel.

17. A vending machine, comprising:

a first partition and a second partition within the vending machine positioned so as to form a channel for holding products to be dispensed by the vending machine;

a dispensing assembly for selectively dispensing a product, the dispensing assembly comprising a dispenser rotatably mounted within the vending machine and substantially aligned with and positioned below a lower end of the channel, and having an open side;

a product chute for delivering the product dispensed by the dispensing assembly;

a reversible motor coupled to the dispensing assembly for rotating the dispenser about an axis and;

a controller electrically coupled to the motor for rotating the dispenser from a first position, wherein the open side is substantially unexposed to the product chute and the dispenser holds the product, to a second position, wherein the open side is exposed to the product chute and the dispenser dispenses the product, to a third position that is substantially the same as the first position, wherein the controller monitors the motor current and causes the motor to reverse its rotation direction when the detected current exceeds a predetermined amount for a predetermined time.

18. The vending machine according to claim 17, further comprising a cam coupled to the dispenser for rotation therewith, and a bumper fixedly mounted to the vending machine and positioned so as to engage the cam to prevent the dispenser from rotating past a first and a second predetermined point.

19. The vending machine according to claim 18, wherein the controller detects the current drawn by the motor, and either reverses or stops rotation of the motor when the current exceeds a predetermined value for a predetermined time.

20. The vending machine according to claim 19, wherein after the controller receives a signal from a product vend detector indicating that a product has been dispensed by the dispenser, the controller causes the motor to reverse its rotation direction to rotate the dispenser for a time period until the open side is substantially no longer exposed to the product chute.

21. The vending machine according to claim 20, wherein the time period is substantially equal to the time required for the rotation to dispense the product.

22. The vending machine according to claim 21, wherein the controller receives input signals to determine the number of products being held within the dispenser.

23. The vending machine according to claim 22, wherein the controller is adapted to direct the motor to rotate the dispenser through a reload cycle when the dispenser is empty.

24. The vending machine according to claim 23, wherein the product vend detector comprises an impact sensor attached to the product chute which generates a product dispensed signal when the product impacts the product chute.

25. The vending machine according to claim 23, wherein the product vend detector comprises an optical sensor located beneath the dispenser which generates a product dispensed signal when the product passes from the dispenser to the product chute.

* * * * *